US007249388B1

(12) United States Patent
Lin

(10) Patent No.: US 7,249,388 B1
(45) Date of Patent: Jul. 31, 2007

(54) PLAYPEN

(75) Inventor: Jui-Pin Lin, Taiping (TW)

(73) Assignee: Time Crown (U.K.) International Ltd., Dongguan (CN)

( * ) Notice: Subject to any disclaimer, the term of this patent is extended or adjusted under 35 U.S.C. 154(b) by 0 days.

(21) Appl. No.: 11/306,832

(22) Filed: Jan. 12, 2006

(51) Int. Cl.
*A47D 7/02* (2006.01)

(52) U.S. Cl. ..... 5/100

(58) Field of Classification Search ..... 5/93.1, 5/100; 292/DIG. 37, 137, 159, 177, 179, 292/182, 150, 145, 302
See application file for complete search history.

(56) References Cited

U.S. PATENT DOCUMENTS 3,193,849 A * 7/1965 Landry ..... 5/100
5,134,734 A * 8/1992 Bozino ..... 5/100
6,922,858 B1 8/2005 Shamie ..... 5/100

* cited by examiner

*Primary Examiner*—Patricia Engle
*Assistant Examiner*—Jonathan Liu
(74) *Attorney, Agent, or Firm*—Alan Kamrath; Kamrath & Associates P.A.

(57) ABSTRACT

A playpen includes four posts, four rails installed between the posts, at least two stems attached to one of the rails and at least two positioning devices each attached to one of the posts for cooperating with the stems for movably installing the rail on the posts. Each of the related posts includes a groove for receiving one of the stems and a dent in communication with the groove. Each of the positioning devices includes a button movable across the detent and a latch including a first portion connected to the button and a second portion. The button is operable so as to move the latch between a locking position where the second portion thereof restrains the stem in the groove and a releasing position where the second portion thereof retreats from the groove.

20 Claims, 11 Drawing Sheets

PLAYPEN

BACKGROUND OF INVENTION

1. Field of Invention

The present invention relates to a playpen.

2. Related Prior Art

Disclosed in U.S. Pat. No. 6,922,858 is a hardware system for a crib. The hardware system includes a rail guide 30. The rail guide 30 defines a guide slot 44, a locking slot 34 and an aperture 38 through which the locking slot 34 is in communication with the guide slot 44. A ramp 46 is formed between the locking slot 34 and the guide slot 44. A cantilever spring 42 is formed near the aperture 38. A pin 20 is driven into a rail. The pin 20 can be moved into the locking slot 34 from the guide slot 44 through the aperture 38. The cantilever spring 42 and the ramp 46 are used to avoid the pin 20 returning to the guide slot 44 from the locking slot 34 through the aperture 38. However, such a design is often inadequate for some reasons. The rail guide 30 is made of plastics. When the rail guide 30 is new, the cantilever spring 42 tends to be too flexible. When a child plays in the crib, the crib rattles. Hence, the pin 20 might jump over the ramp 46, press the cantilever spring 42, and fall back into the guide slot 44. In this case, the crib might collapse, and the child might get hurt. When the rail guide 30 is old, the cantilever spring 42 tends to be fragile. In this case, the cantilever spring 42 might be broken and lose its ability to restrain the pin 20.

The present invention is intended to obviate or at least alleviate the problems encountered in the prior art.

SUMMARY OF INVENTION

According to the present invention, a playpen includes four posts, four rails installed between the posts, at least two stems attached to one of the rails and at least two positioning devices each attached to one of the posts for cooperating with the stems for movably installing the rails on the posts. Each of the related posts includes a groove for receiving one of the stems and a dent in communication with the groove. Each of the positioning devices includes a button movable across the detent and a latch including a first portion connected to the button and a second portion. The button is operable so as to move the latch between a locking position where the second portion thereof restrains the stem in the groove and a releasing position where the second portion thereof retreats from the groove.

The primary advantage of the playpen of the present invention is that the latch firmly locks the stem, and this is secure.

Other advantages and features of the present invention will become apparent from the following description referring to the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
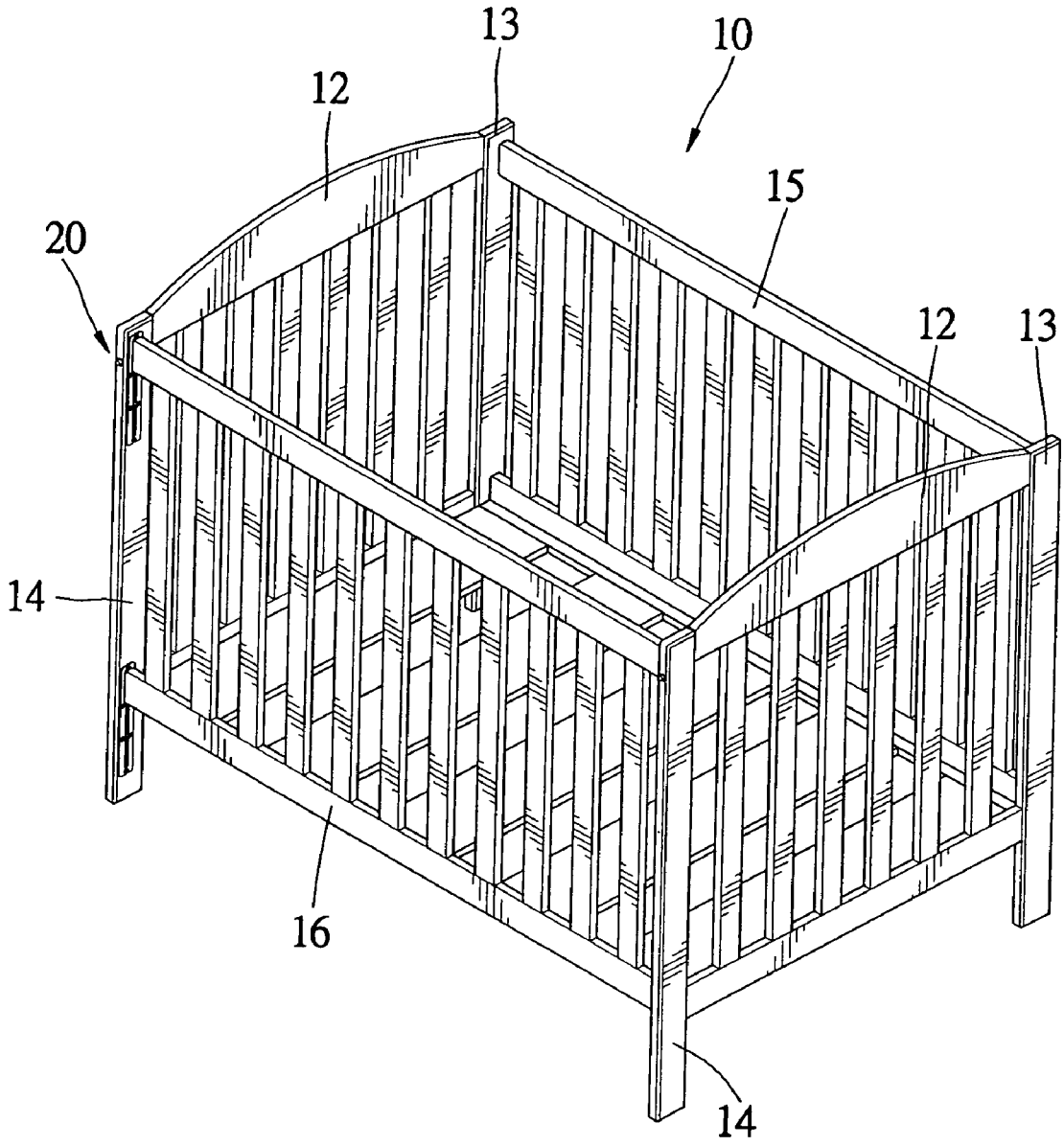
FIG. 1 is a perspective view of a playpen according to the preferred embodiment of the present invention.
Figure 2:
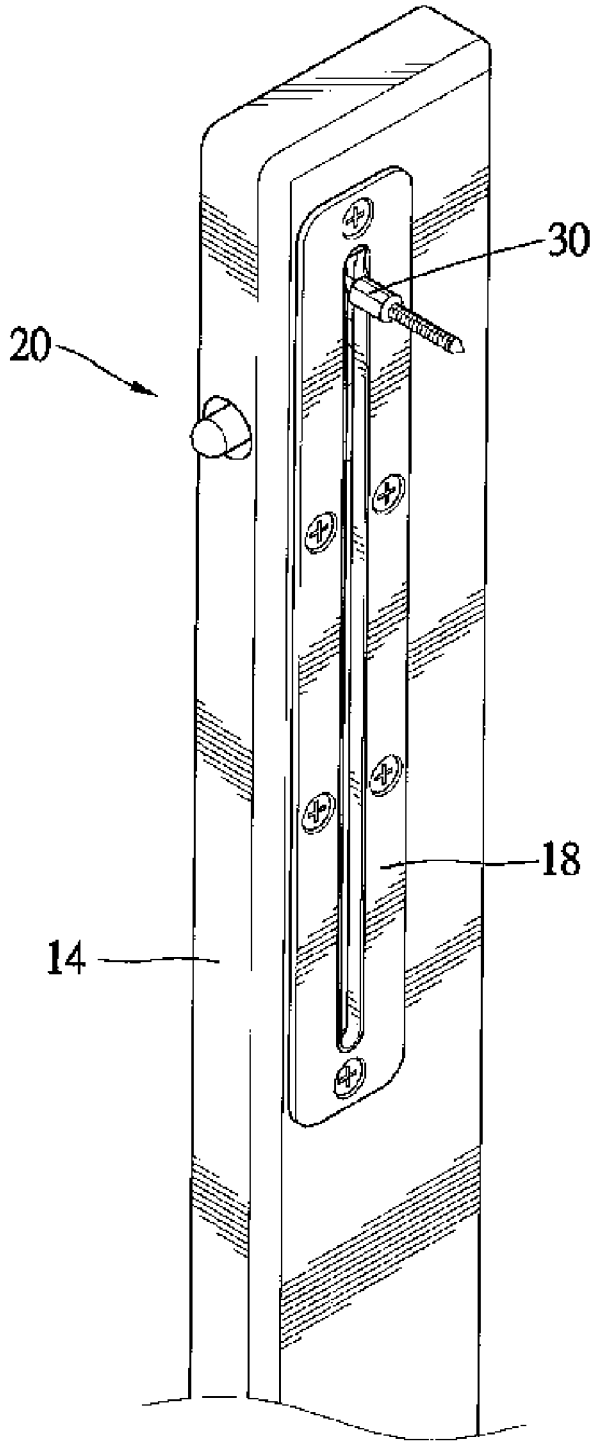
FIG. 2 is a perspective view of a positioning device used in the playpen shown in FIG. 1.
Figure 3:
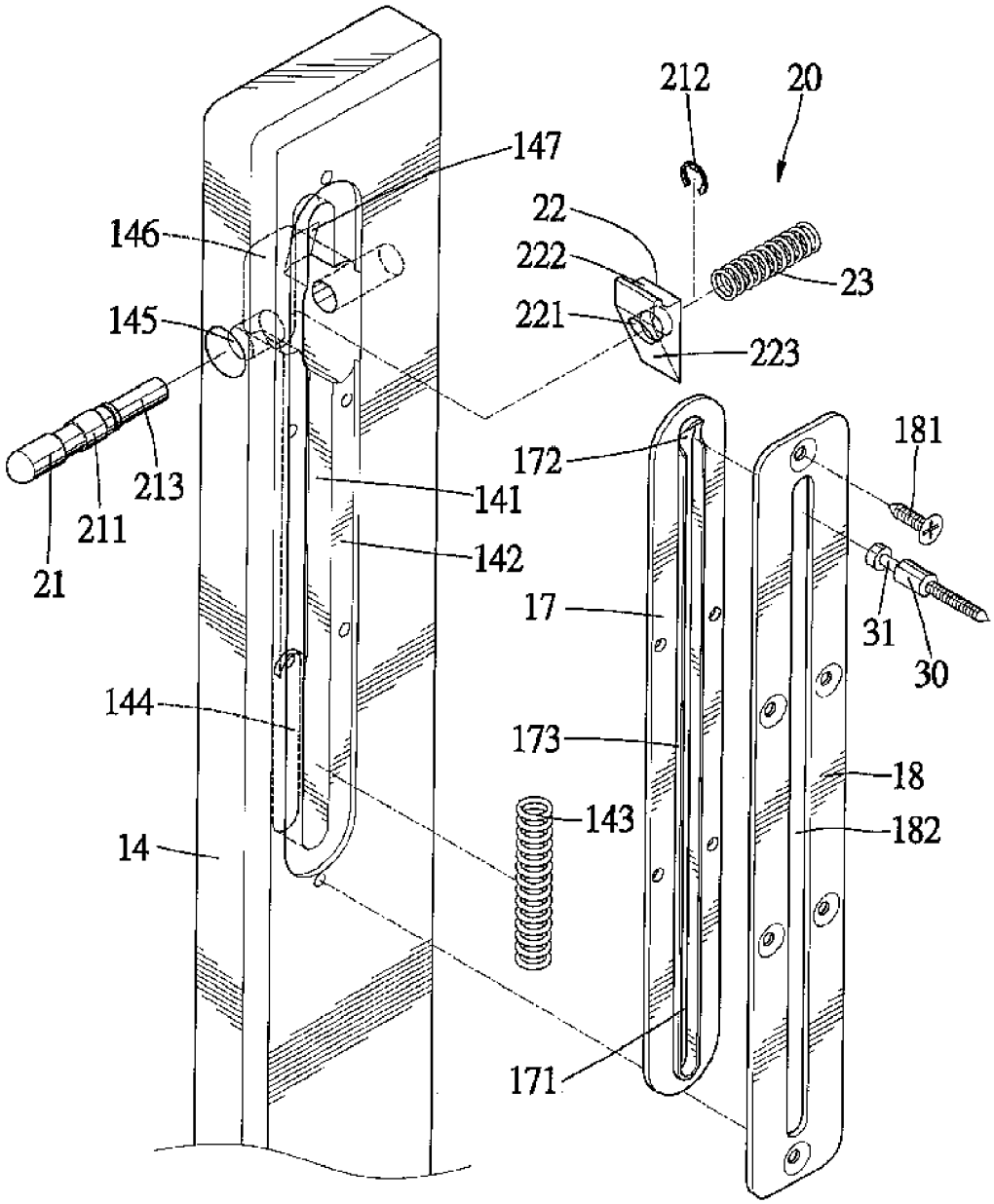
FIG. 3 is an exploded view of the positioning device shown in FIG. 2.

Referring to FIG. 1, there is shown a playpen 10 according to the preferred embodiment of the present invention. The playpen 10 includes two rear posts 13, two front posts 14, two side rails 12 installed between the front posts 14 and the rear posts 13, a rear rail 15 securely installed between the rear posts 13 and a front rail 16 movably installed between the front posts 14. Each front post 14 is equipped with two positioning devices 20 for cooperation with two stems 30 projecting from each vertical edge of the front rail 16 so that the front rail 16 is movably installed on the front posts.

Figure 4:
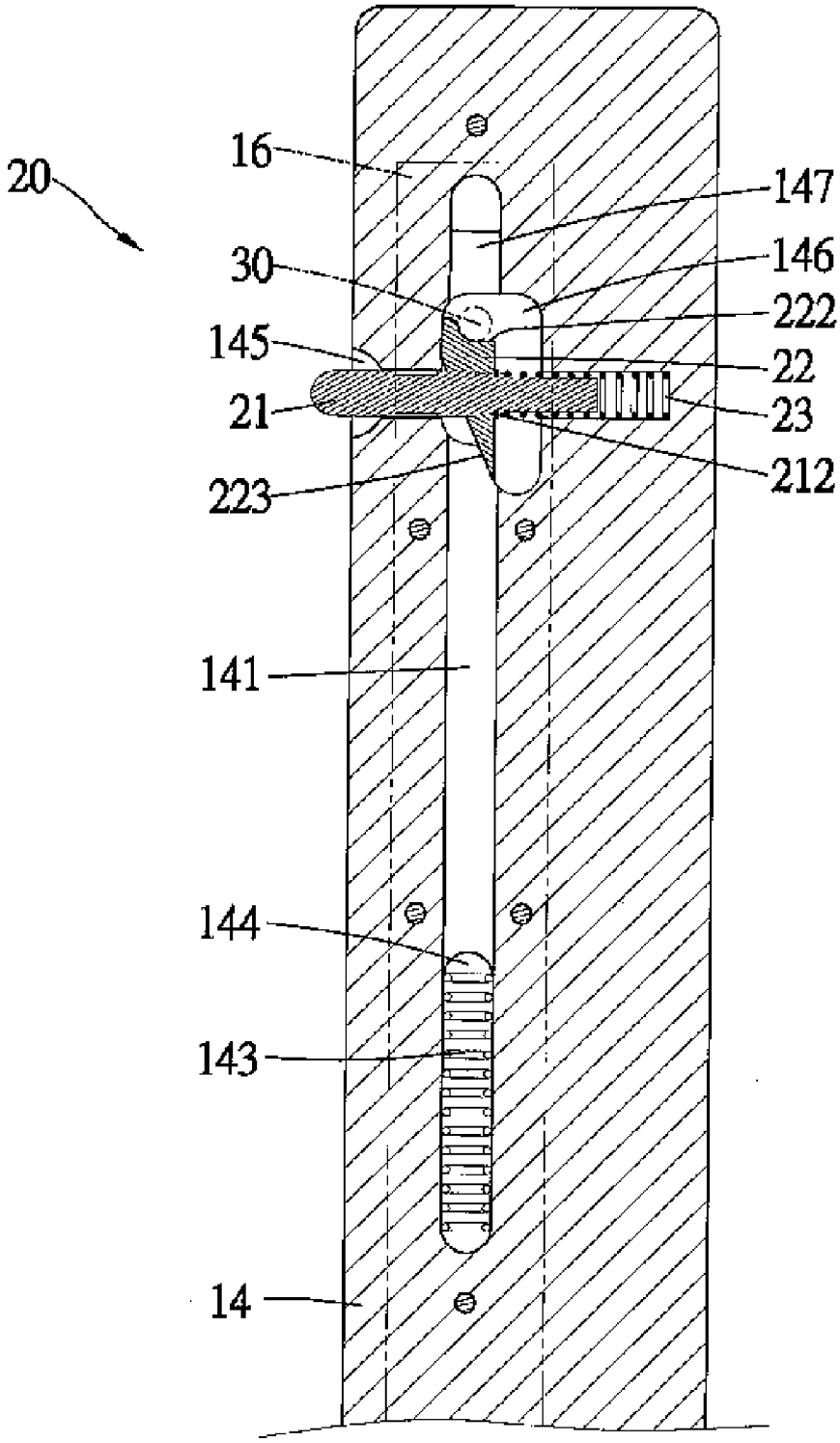
FIG. 4 is a cross-sectional view of the positioning device of FIG. 2.
Figure 5:
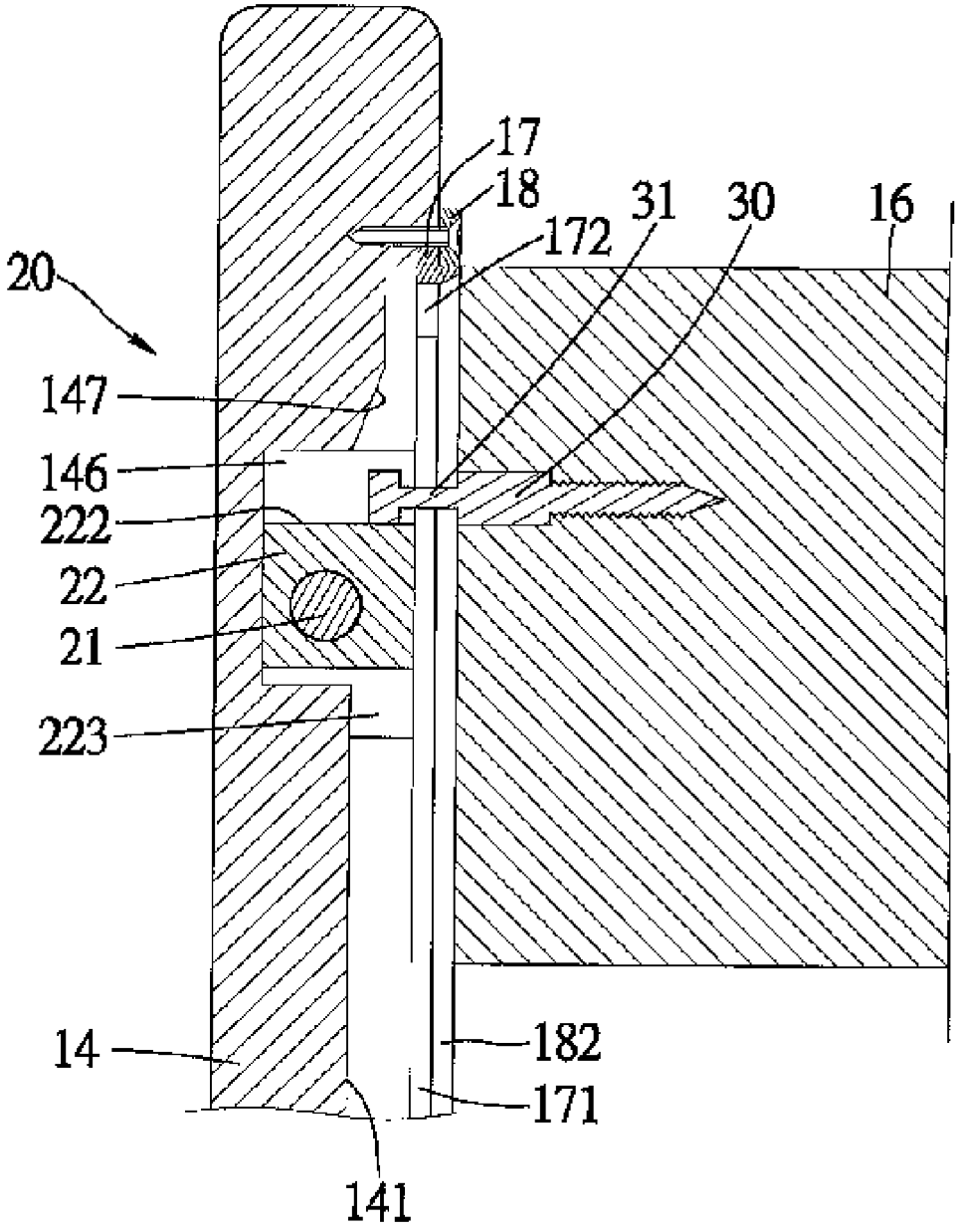
FIG. 5 is another cross-sectional view of the positioning device shown in FIG. 4.

Referring to FIGS. 2 through 5, for each positioning device 20, each front post 14 defines a long and shallow recess 142, a groove 141 in communication with the recess 142, a pocket 144 in communication with the groove 141 and the recess 142, a dent 146 in communication with the groove 141, a slope 147 sinking to the dent 146 from the groove 141 as best shown in FIG. 5 and a cave 145 in communication with the dent 146 as best shown in FIG. 4.

Each positioning device 20 includes a button 21, a latch 22 and a spring 23. The button 21 includes a stepped body 211, a round head at an end of the stepped body 211, a tail 213 at an opposite end of the stepped body 211 and an annular groove between the stepped body 211 and the tail 213.

The latch 22 defines a stepped aperture 221 like a countersink hole, and includes a tongue 222 projecting from an upper end and a slope 223 extending to the upper end from a lower end. The latch 22 includes a first portion and a second portion.

The spring 23 is located in the cave 145. The first portion of the latch 22 is located in the dent 146 while the second portion of the latch 22 is located in the groove 141. The button 21 is located in the cave 145. The tail 213 of the button 21 is located in the spring 23. The stepped body 211 of the button 21 is located in the stepped aperture 221 of the latch 22. A C-clip 212 is fit in the annular groove of the button 21 so that the latch 22 is retained on the button 21 and that the positioning device 20 is retained on the front post 14. Exposed from the cave 145 is the round head of the button 21 for contact with a user's finger.

Each stem 30 includes a screw at an end and a neck 31 near an opposite end. The screw of the stem 30 is driven into the front rail 16. The neck 31 is made with a reduced diameter.

A spring 143 is located in the pocket 144.

A guide 17 is a metal strip shaped corresponding to the recess 142. The thickness of the guide 17 is equal to the depth of the recess 142. The guide 17 defines a slot 171, an aperture 172 in communication with the slot 171 and a wall 173 extending around a substantial section of the slot 171. The diameter of the aperture 172 is marginally larger than that of the stem 30. The width of the slot 171 is marginally larger than the diameter of the neck 31 of the stem 30.

The guide 17 is located in the recess 142 so that the guide 17 is flush with the front post 14.

A cover 18 defines a slot 182. The cover 18 is secured to the front post 14 by fasteners 181 such as screws. The cover 18 retains the guide 17 and the spring 143 to the front post 14. The wall 173 extends through the slot 182.

The stem 30 is inserted into the groove 141 through the aperture 172. The stem 30 is lowered so as to rest on the latch 22. The tongue 222 of the latch 22 is located against the stem 30. Now, the neck 31 of the stem 30 is located in the slot 171 and restrained by the wall 173.

Referring to FIGS. 4 and 5, the latch 22 is kept in a locking position by the spring 23. The latch 22 is firmly supported on the button 21. The button 21 cannot be pushed because the tongue 222 is located against the stem 30. Therefore, the stem 30 is firmly restrained by the latch 22.

Figure 6:
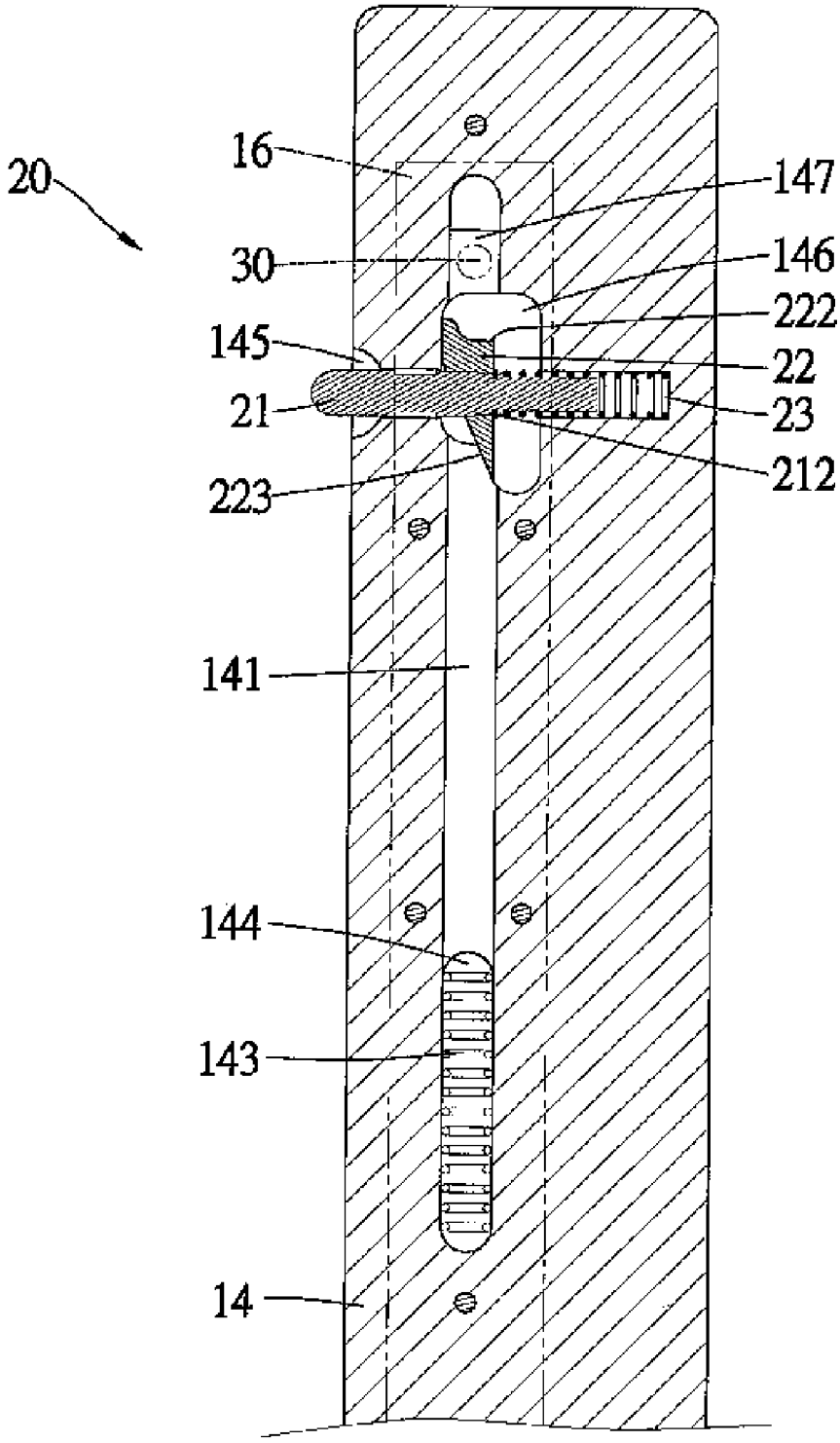
FIG. 6 is a cross-sectional view of the positioning device in another position than shown in FIG. 4.

Referring to FIG. 6, the stem 30 is lifted from the latch 22 so that the stem 30 is not located against the tongue 222. Hence, the button 21 can be pushed.

Figure 7:
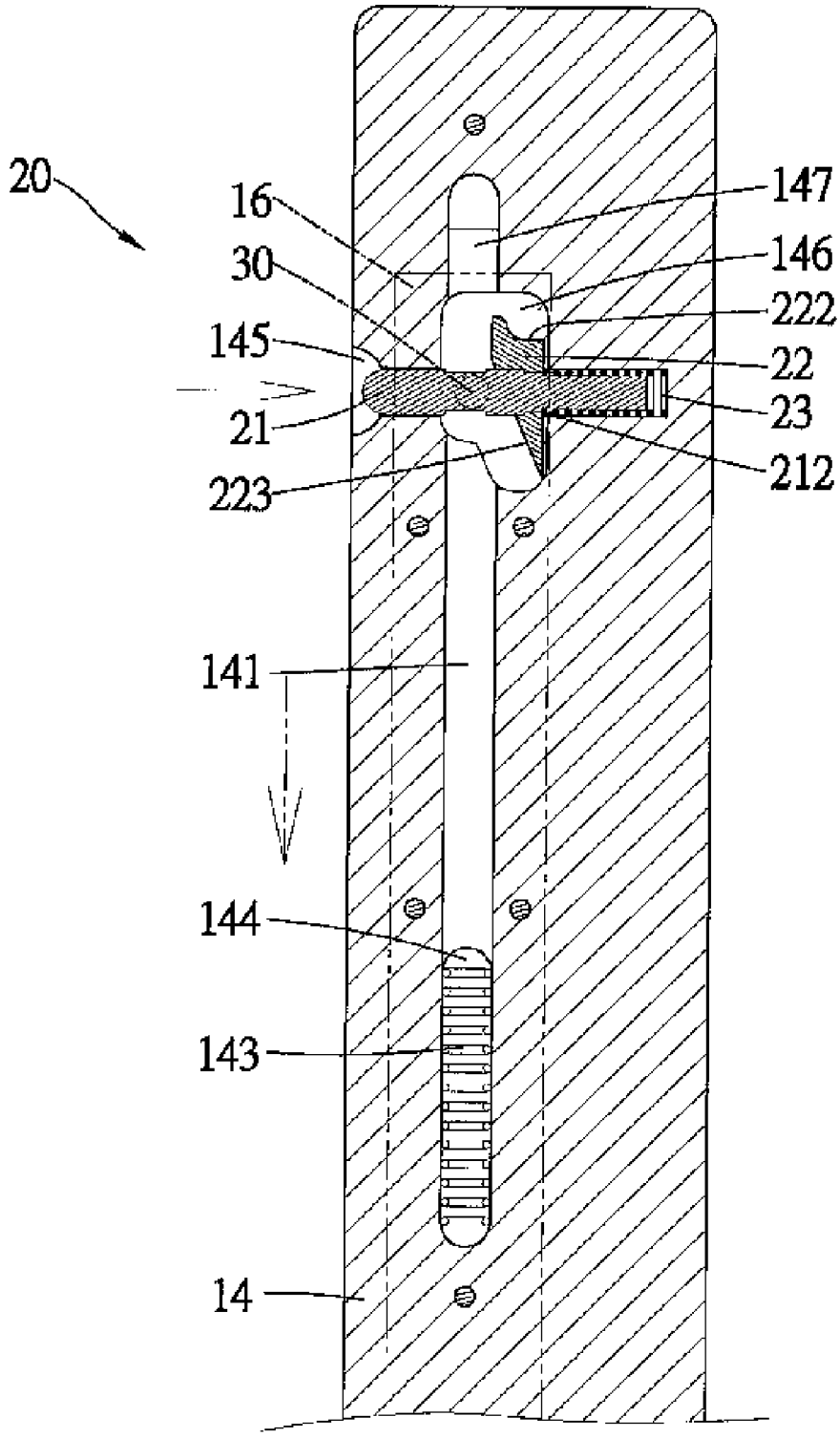
FIG. 7 is a cross-sectional view of the positioning device in another position than shown in FIG. 6.
Figure 8:
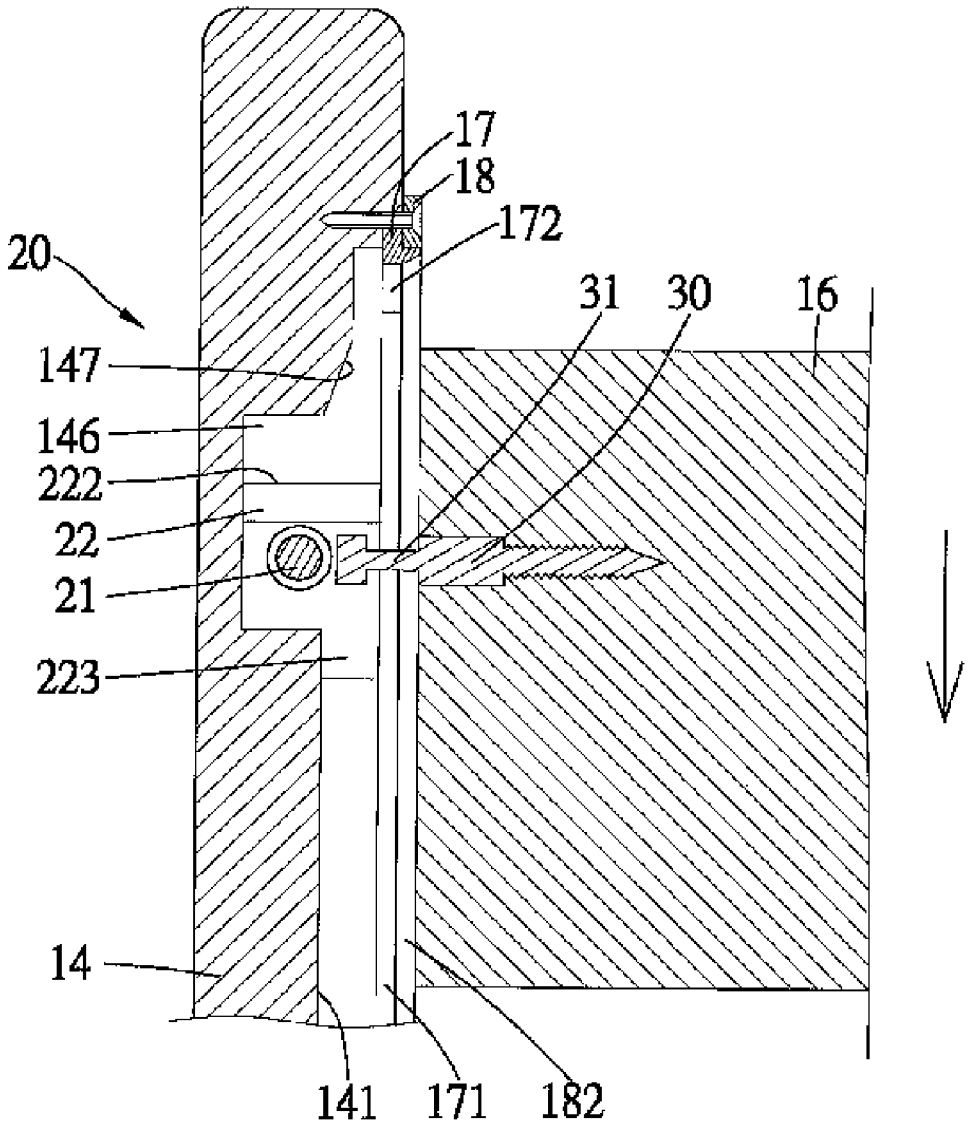
FIG. 8 is another cross-sectional view of the positioning device shown in FIG. 7.

Referring to FIGS. 7 and 8, the button 21 is pushed, and the latch 22 is moved from the groove 141. Therefore, the stem 30 can be lowered.

Figure 9:
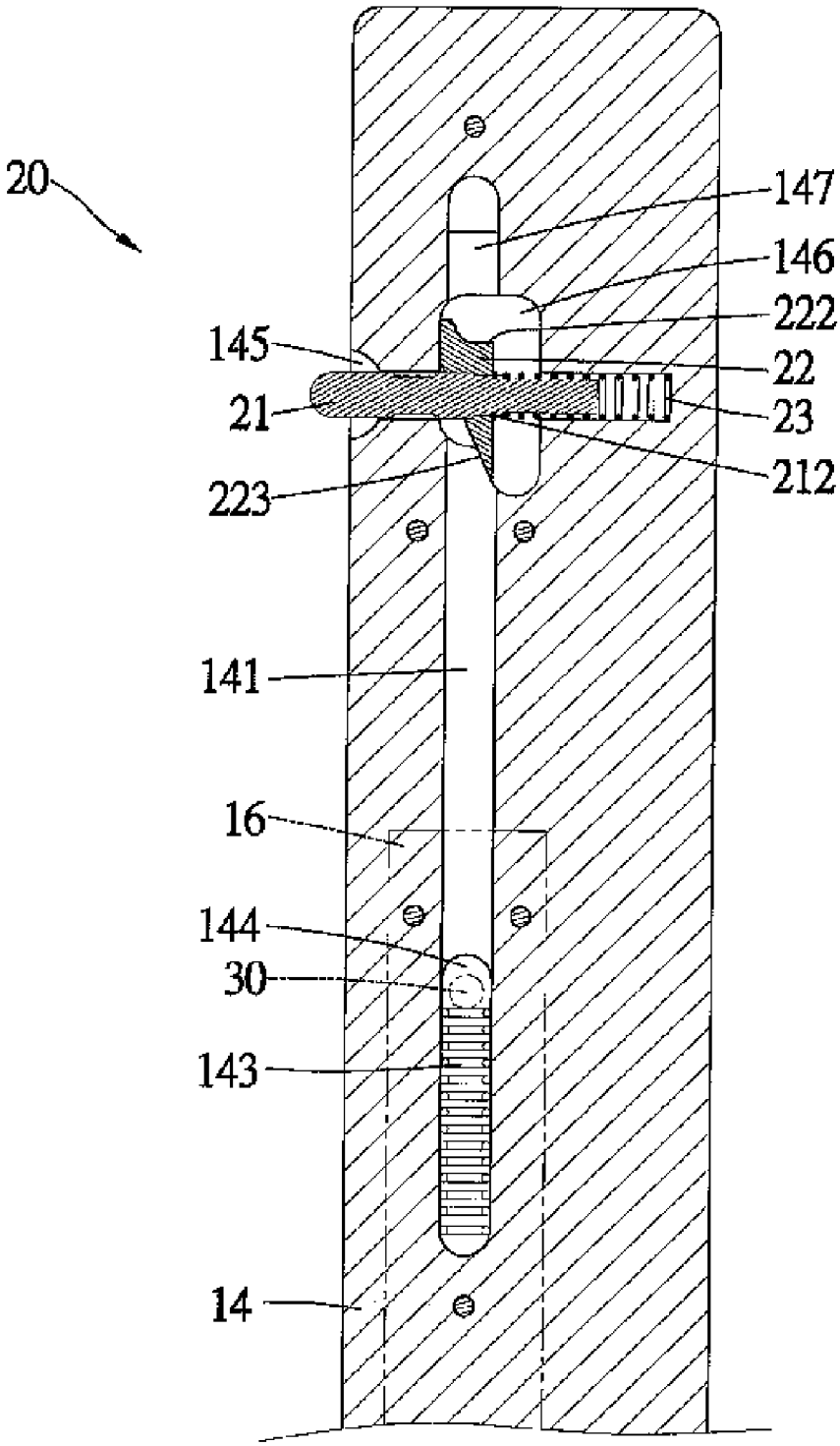
FIG. 9 is a cross-sectional view of the positioning device in another position than shown in FIG. 7.
Figure 10:
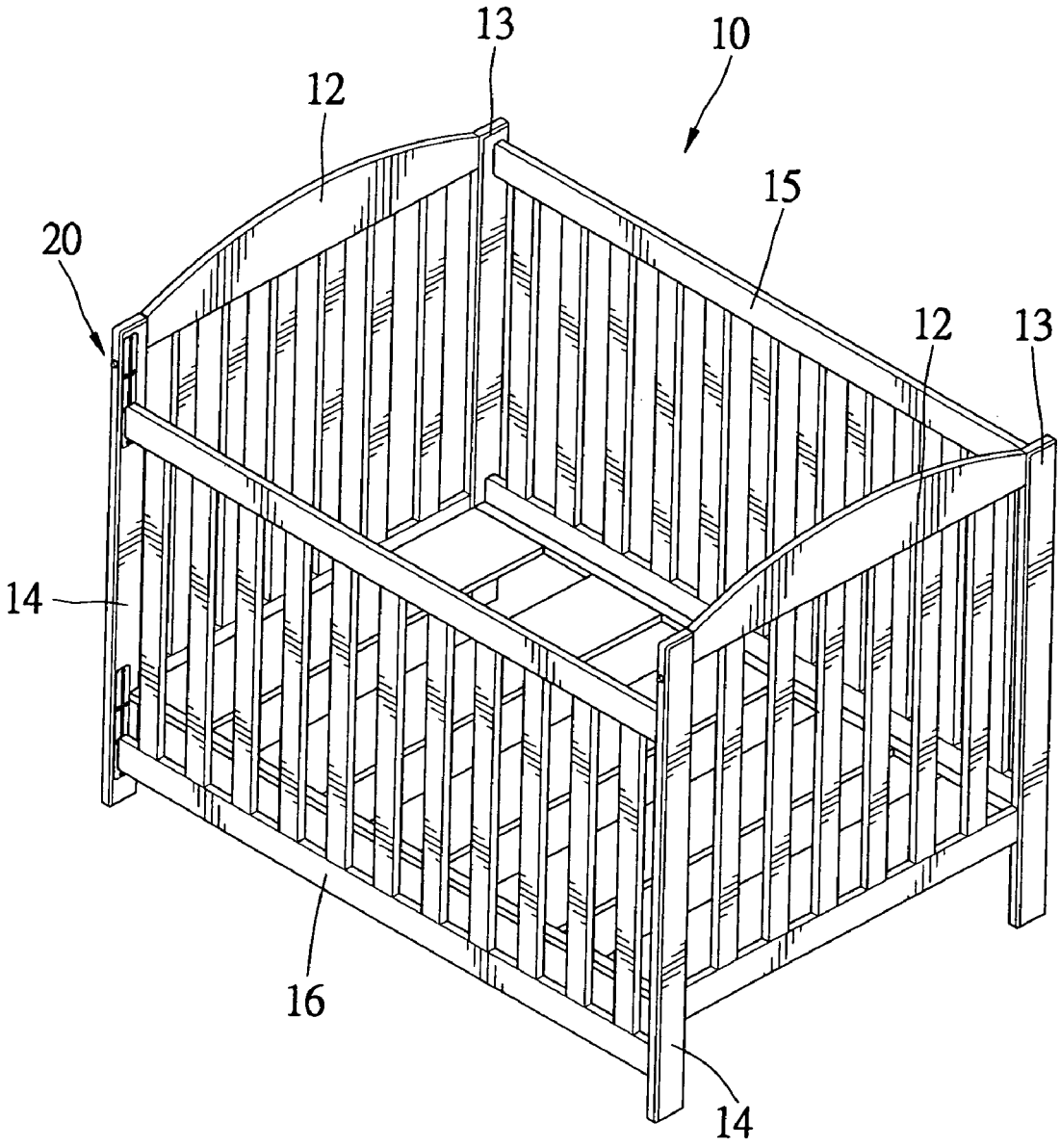
FIG. 10 is a perspective view of the playpen in a position related to that of the positioning device shown in FIG. 9.

Referring to FIGS. 9 and 10, the stem 30 falls and hits the spring 143. The spring 143 cushions the stem 30 for protection. Accordingly, the front rail 16 is lowered.

Figure 11:
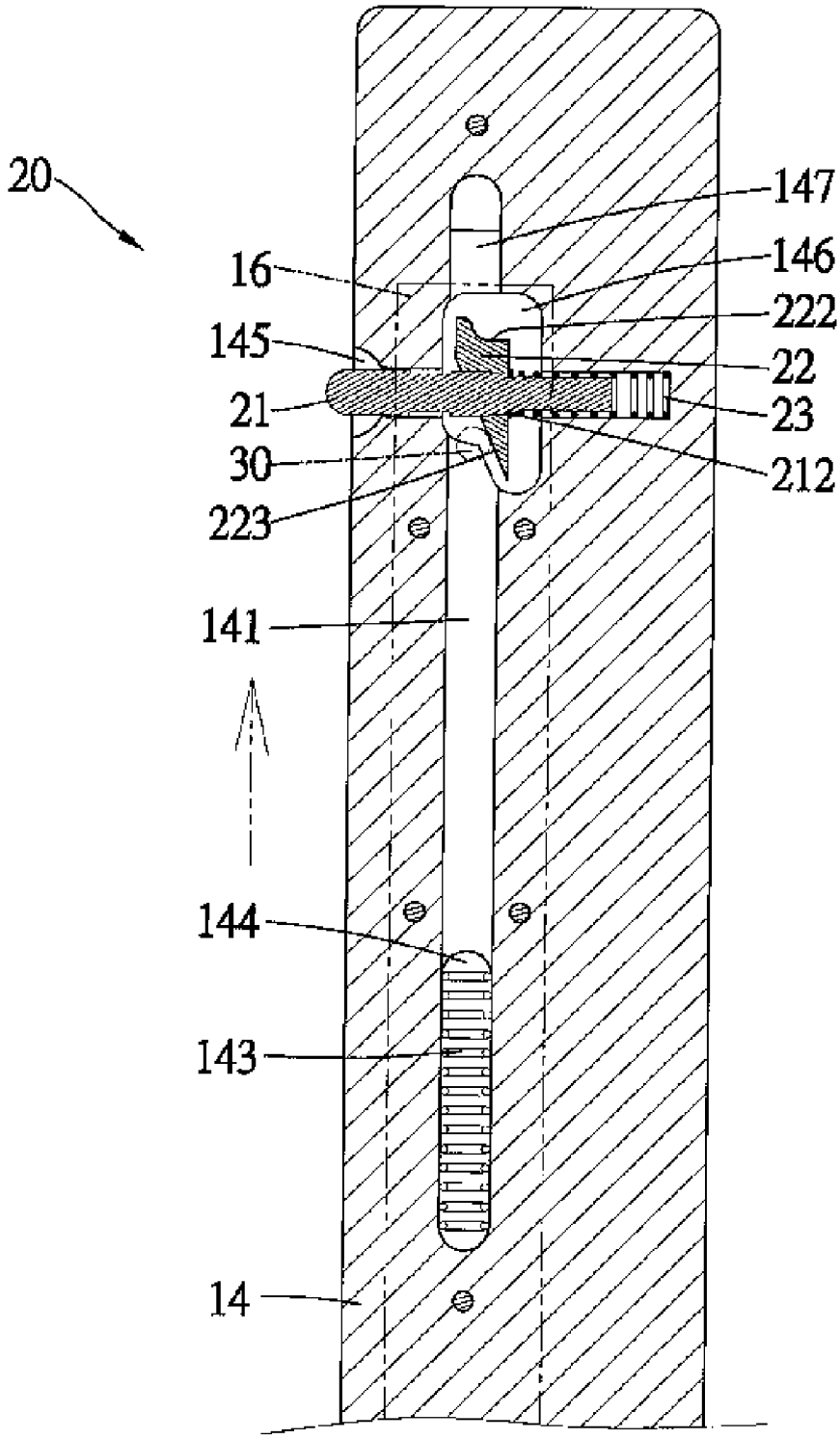
FIG. 11 is a cross-sectional view of the positioning device in another position than shown in FIG. 9.

Referring to FIG. 11, the stem 30 is lifted from the spring 143. As the stem 30 comes into contact with the slope 223, the former slides on and pushes away the latter. Hence, the stem 30 can be returned to the position shown in FIGS. 4 and 5.

The playpen of the present invention exhibits some advantages. At first, the latch 22 firmly locks the stem 30, and this is secure. Secondly, the front rail 16 can only be lowered after it is lifted and the button 21 is pushed, and this is secure. Thirdly, the stem 30, on its way up, slides on and pushes away the slope 223 of the latch 22, and this is convenient.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A playpen comprising four posts; four rails installed between the posts; at least two stems attached to one of the rails; and at least two positioning devices each attached to one of the posts for cooperating with the stems for movably installing the rail on the posts, wherein:

each of the related posts comprises a groove for receiving one of the stems and a detent in communication with the groove;

each of the positioning devices comprises a button movable across the detent and a latch comprising a first portion connected to the button and a second portion, wherein the button is operable so as to move the latch between a locking position where the second portion restrains the stem in the groove and a releasing position where the second portion retreats from the groove, wherein the button comprises a stepped body, wherein the latch defines a stepped aperture for receiving the stepped body of the button.

2. The playpen according to claim 1 wherein the latch comprises a tongue located against the stem so that the latch cannot be moved to the releasing position by pushing the button.

3. A playpen comprising four posts; four rails installed between the posts; at least two stems attached to one of the rails; and at least two positioning devices each attached to one of the posts for cooperating with the stems for movably installing the rail on the posts, wherein:

each of the related posts comprises a groove for receiving one of the stems and a detent in communication with the groove;

each of the positioning devices comprises a button movable across the detent and a latch comprising a first portion connected to the button and a second portion, wherein the button is operable so as to move the latch between a locking position where the second portion restrains the stem in the groove and a releasing position where the second portion retreats from the groove, wherein each of the positioning devices comprises a C-clip for clipping the button so as to retain the latch.

4. A playpen comprising four posts; four rails installed between the posts; at least two stems attached to one of the rails; and at least two positioning devices each attached to one of the posts for cooperating with the stems for movably installing the rail on the posts, wherein:

each of the related posts comprises a groove for receiving one of the stems and a detent in communication with the groove;

each of the positioning devices comprises a button movable across the detent and a latch comprising a first portion connected to the button and a second portion, wherein the button is operable so as to move the latch between a locking position where the second portion restrains the stem in the groove and a releasing position where the second portion retreats from the groove, wherein each of the related posts comprises a cave in communication with the detent, wherein the button is movable in the cave across the detent.

5. The playpen according to claim 4 wherein each of the positioning devices comprises a spring located in the cave so as to push the latch to the locking position.

6. The playpen according to claim 5 wherein the button comprises a tail inserted in the spring.

7. The playpen according to claim 4 wherein the latch comprises a tongue located against the stem so that the latch cannot be moved to the releasing position by pushing the button.

8. The playpen according to claim 4 wherein the latch comprises a slope on which the stem can slide so as to push away the latch.

9. The playpen according to claim 4 comprising a cushion for cushioning the stem in the groove.

10. The playpen according to claim 9 wherein the cushion is a spring.

11. The playpen according to claim 10 wherein the post defines a pocket for receiving the spring.

12. The playpen according to claim 4 comprising a guide attached to the post so as to guide the stem.

13. The playpen according to claim 12 wherein the guide defines a slot for receiving the stem.

14. The playpen according to claim 13 wherein the stem comprises a neck movably located in the slot.

15. A playpen comprising four posts; four rails installed between the posts; at least two stems attached to one of the rails; at least two positioning devices each attached to one of the posts for cooperating with the stems for movably installing the rail on the posts, wherein:

each of the related posts comprises a groove for receiving one of the stems and a detent in communication with the groove;

each of the positioning devices comprises a button movable across the detent and a latch comprising a first portion connected to the button and a second portion, wherein the button is operable so as to move the latch between a locking position where the second portion restrains the stem in the groove and a releasing position where the second portion retreats from the groove; and a guide attached to the post so as to guide the stem, wherein the post defines a recess for receiving the guide.

16. A playpen comprising four posts; four rails installed between the posts; at least two stems attached to one of the rails; at least two positioning devices each attached to one of the posts for cooperating with the stems for movably installing the rail on the posts, wherein:

each of the related posts comprises a groove for receiving one of the stems and a detent in communication with the groove;

each of the positioning devices comprises a button movable across the detent and a latch comprising a first portion connected to the button and a second portion, wherein the button is operable so as to move the latch between a locking position where the second portion restrains the stem in the groove and a releasing position where the second portion retreats from the groove; and a guide attached to the post so as to guide the stem, wherein the guide defines a slot for receiving the stem, wherein the stem comprises a neck movably located in the slot, wherein the guide defines an aperture in communication with the slot, the diameter of the aperture is larger than the width of the slot, and wherein the stem can be inserted in the aperture so that the neck of the stem can be moved into the slot from the aperture.

17. The playpen according to claim 16 comprising a cover for shielding the guide on the post, wherein the cover defines a slot for receiving the wall.

18. The playpen according to claim 17 comprising a plurality of fasteners for securing the cover to the post.

19. The playpen according to claim 18 wherein the fasteners are screws.

20. A playpen comprising four posts; four rails installed between the posts; at least two stems attached to one of the rails; at least two positioning devices each attached to one of the posts for cooperating with the stems for movably installing the rail on the posts, wherein:

each of the related posts comprises a groove for receiving one of the stems and a detent in communication with the groove;

each of the positioning devices comprises a button movable across the detent and a latch comprising a first portion connected to the button and a second portion, wherein the button is operable so as to move the latch between a locking position where the second portion restrains the stem in the groove and a releasing position where the second portion retreats from the groove; and a guide attached to the post so as to guide the stem, wherein the guide defines a slot for receiving the stem, wherein the stem comprises a neck movably located in the slot, wherein the guide comprises a wall around the slot so as to restrain the neck of the stem.

* * * * *